US008147566B2

(12) United States Patent
Krogh et al.

(10) Patent No.: US 8,147,566 B2
(45) Date of Patent: Apr. 3, 2012

(54) FUEL ADDITIVE, ADDITIVE-CONTAINING FUEL COMPOSITIONS AND METHOD OF MANUFACTURE

(76) Inventors: James A. Krogh, Janesville, WI (US); Robert A. Swenson, Janesville, WI (US); Clifford J. Hazel, Cornwall (GB); Ian V. Williamson, Cheshire (GB)

( * ) Notice: Subject to any disclaimer, the term of this patent is extended or adjusted under 35 U.S.C. 154(b) by 1157 days.

(21) Appl. No.: 11/982,605

(22) Filed: Nov. 2, 2007

(65) Prior Publication Data

US 2008/0250703 A1 Oct. 16, 2008

Related U.S. Application Data

(63) Continuation of application No. 10/374,687, filed on Feb. 26, 2003, now abandoned, which is a continuation of application No. 10/130,854, filed on May 21, 2002, now abandoned.

(30) Foreign Application Priority Data

Nov. 23, 1999 (GB) ..... 9927563.8
May 2, 2000 (GB) ..... 0010575.9

(51) Int. Cl.
*C10L 1/32* (2006.01)
*C10L 1/18* (2006.01)
*C10L 1/22* (2006.01)

(52) U.S. Cl. ..... 44/301; 44/302; 44/336; 44/385; 44/417; 44/418; 44/443; 44/457

(58) Field of Classification Search ..... 44/336, 44/385, 417, 418, 443, 457, 301, 302
See application file for complete search history.

(56) References Cited

U.S. PATENT DOCUMENTS

| | | | | |
|---|---|---|---|---|
| 5,404,841 | A | | 4/1995 | Valentine |
| 5,522,218 | A | | 6/1996 | Lane et al. |
| 5,535,708 | A | | 7/1996 | Valentine |
| 5,584,265 | A | | 12/1996 | Rao et al. |
| 5,609,026 | A | | 3/1997 | Berriman et al. |
| 5,746,783 | A | * | 5/1998 | Compere et al. ..... 44/301 |
| 5,752,989 | A | | 5/1998 | Henly |
| 5,783,160 | A | | 7/1998 | Kinugasa et al. |
| 5,791,139 | A | | 8/1998 | Atago et al. |
| 5,992,141 | A | | 11/1999 | Berriman et al. |
| 6,017,369 | A | | 1/2000 | Ahmed |

(Continued)

FOREIGN PATENT DOCUMENTS

WO WO 97/04045 2/1997

(Continued)

*Primary Examiner* — Cephia D Toomer
(74) *Attorney, Agent, or Firm* — James M. Duncan, Esq.; R. Scott Kimsey, Esq.; Klein, DeNatale, Goldner, et al.

(57) ABSTRACT

The present invention relates to fuel additives, fuel compositions and methods of manufacture in which the additives are provided to impart desired properties to fuels. These properties include, without limitation, reduction of nitrogen oxide and particulate emissions from the exhaust stream of internal combustion engines using the fuels. Preferred embodiments of an additive form of the composition include a nitrogen-containing compound selected from the group consisting of urea, cyanuric acid, triazine, ammonia and mixtures thereof, a carrier blend comprising an alkoxylated alcohol, a polyalkylene glycol ester and an alkanolamide and water. The additive may be provided in a concentrate form by addition of a solvent or may be provided as a final form fuel composition. A method of additive manufacture and is disclosed.

40 Claims, 8 Drawing Sheets

U.S. PATENT DOCUMENTS

| | | | |
|---|---|---|---|
| 6,030,521 | A | 2/2000 | Jessup et al. |
| 6,074,445 | A | 6/2000 | Ahmed |
| 6,183,524 | B1 | 2/2001 | Ahmed |
| 6,190,427 | B1 | 2/2001 | Ahmed |
| 6,218,353 | B1 | 4/2001 | Romack |
| 6,695,890 | B1 | 2/2004 | Hazel |
| 2004/0123515 | A1 | 7/2004 | Krogh |

FOREIGN PATENT DOCUMENTS

| | | | |
|---|---|---|---|
| WO | WO 98/17745 | | 4/1998 |
| WO | WO 98/22209 | | 5/1998 |
| WO | WO 99/01205 | | 1/1999 |
| WO | WO 99/20715 | | 4/1999 |
| WO | WO 99/52994 | | 10/1999 |
| WO | WO 00/15740 | | 3/2000 |
| WO | WO 00/31216 | | 6/2000 |
| WO | WO00-36055 | | 6/2000 |
| WO | WO 01/10982 | A1 | 2/2001 |
| WO | WO 01/38464 | A1 | 5/2001 |
| WO | WO 01/44413 | A2 | 6/2001 |
| WO | WO 01/62876 | A1 | 8/2001 |
| WO | WO 01/62877 | A1 | 8/2001 |
| WO | WO03-040271 | | 5/2003 |

* cited by examiner

50/25/25 Carrier Blend

34/33/33 Carrier Blend

Top 20% of 34/33/33 Ternary
Phase Diagram

Tomadol 1-3 vs Tomadol 91-2.5
in 34/33/33 Formula

Iso C10 Alcohol + 2.5 EO
In 34/33/33 Formula

34/33/33 Formula in Gasoline

Formulation from U.S. Patent 5,746,783
with 40% Urea and Diesel Fuel

Comparison of Formulation from U.S. 5,746,783 to Preferred Formulation of This Invention

FUEL ADDITIVE, ADDITIVE-CONTAINING FUEL COMPOSITIONS AND METHOD OF MANUFACTURE

This application is a continuation of U.S. patent application Ser. No. 10/374,687, filed Feb. 26, 2003, now abandoned which is a continuation of U.S. patent application Ser. No. 10/130,854, filed May 21, 2002, now abandoned.

FIELD OF THE INVENTION

This invention is related generally to fuel additives and to fuels formulated with the additives and a method of manufacture.

BACKGROUND OF THE INVENTION

Reduction of internal combustion engine exhaust emissions is a fundamental problem confronting the automotive industry worldwide. Nitrogen oxide ("$NO_x$") emissions are a class of engine exhaust emissions which are coming under increasingly strict regulatory scrutiny because of their asserted affect on the environment. $NO_x$ emissions from internal combustion engines are, for example, asserted to be precursors in the formation of ozone and are further asserted to be responsible for the formation of other types of air pollution, such as smog.

Diesel engines present a further problem for the automotive and transportation industry in that the exhaust emissions from these type of engines typically include large amounts of particulates together with $NO_x$. The particulate emissions are present in the black smoke discharged from the engine. Currently, diesel engine particulate emissions can be controlled by the use of filters or catalytic converters. While these emission-control devices are effective in decreasing particulate emissions, they do not appear to be effective in reducing $NO_x$ emissions.

Attempts have been made to reduce $NO_x$ and particulate emissions from internal combustion engines. However, these known emission control systems and strategies have associated disadvantages.

One known method of reducing $NO_x$ emissions involves treating the post-combustion exhaust emissions. For example, PCT patent publication WO 98/22209A1, (Peterhoblyn et al.) discloses the use of selective catalytic reduction (SCR) in which an aqueous urea solution is introduced from a tank into the engine exhaust manifold. The urea-containing exhaust gas is then directed to a foraminous structure that traps any water or urea that has not been gasified. Subsequently, the exhaust gas is directed through an $NO_x$-reducing catalyst structure. PCT patent publication WO 99/01205 (Marko et al.) discloses a further type of SCR in which gaseous ammonia is introduced to the post combustion exhaust gas followed by treatment with a reduction catalyst.

U.S. Pat. Nos. 5,783,160 (Kinugasa et al.), 5,992,141 (Berriman et al.) and 5,609,026 (Berriman et al.) also disclose a type of engine exhaust treatment in which gaseous ammonia is introduced to the post combustion exhaust gas followed by treatment with a catalyst. Other publications disclosing apparatus for treating engine exhaust to reduce $NO_x$ emissions, such as catalytic converters, include U.S. Pat. Nos. 5,522,218 (Lane et al.) and 5,791,139 (Takeshi et al.).

All of the aforementioned $NO_x$-reducing systems are disadvantageous because of the extensive and costly mechanical structure required for operation of the systems.

Another method of treating post-combustion exhaust emissions involves a process known as exhaust gas recirculation (EGR). Such a system is disclosed in PCT patent publication WO 97/04045A1 (Peterhoblyn et al.) which describes the use of EGR, or an engine timing modification, in combination with a particulate trap and a platinum group metal catalyst composition. While possibly effective in reducing $NO_x$ emissions, this system disadvantageously requires costly mechanical and catalytic components.

Yet another known method of reducing $NO_x$ emissions involves introduction of a selective reducing agent directly into the engine combustion chamber such as shown in U.S. Pat. No. 5,584,265 (Rao et al.). According to Rao, a selective reducing agent such as ammonia, hydrazine, or cyanuric acid is injected into the interior of the piston-cylinder assembly with a mechanical material-feed apparatus. The reducing agent is stored in a tank within the vehicle. The reducing agent reacts during combustion to produce an exhaust stream with a reduced concentration of $NO_x$. The system of the Rao patent disadvantageously requires the use of complex and costly mechanical apparatus in order to introduce the correct amount of reducing agent into the combustion chamber.

Various fuel additives and formulations have been proposed as a means of reducing $NO_x$ emissions. Certain of these compositions are provided to solubilize water in the fuel thereby cooling the fuel charge and reducing the $NO_x$ emissions. One such example is provided in PCT patent publication WO 98/17745 (Hazel et al.) which discloses prior work of two of the present applicants. The Hazel invention provides a surfactant to solubilize water present in the fuel. The surfactant comprises an alkoxylated alcohol, a diethanolamide and a polyethylene glycol monoester. PCT patent publication WO 00/15740 (Daly et al.) discloses an emulsified water-blended fuel composition containing a liquid fuel, water, an emulsifier, an amine salt which may function as an emulsion stabilizer or combustion modifier. These compositions, while efficacious in certain applications, are not optimally effective in reducing $NO_x$ emissions and are not effective in solubilizing $NO_x$-reducing agents.

Another approach to general reduction of emissions from diesel fuel involves use of a surfactant system to stabilize anhydrous or hydrous ethanol in diesel fuel thereby reducing the overall fuel hydrocarbon-content. U.S. Pat. No. 6,017,369 (Ahmed) discloses a solubilized diesel fuel composition including diesel fuel, ethanol, an alkyl ester of a fatty acid, a stabilizing additive and an optional co-solvent. The stabilizing additive is reportedly provided to homogenize the constituents of the fuel composition. The stabilizing agent is reported to be either (1) a mixture of ethoxylated alcohols, a cetane booster and a demulsifier or (2) a mixture of ethoxylated alcohols, an amide and an ethoxylated fatty acid. While reportedly effective in reducing diesel fuel emissions generally (as a result of reducing the percentage of diesel fuel in the composition), the Ahmed composition does not disclose any specific assertion of $NO_x$ or particulate emission reduction.

U.S. Pat. No. 5,746,783 (Compere et al.) discloses a microemulsion of urea or a triazine which, when added to a base diesel fuel composition, is said to decrease the amount of $NO_x$ emissions from diesel engines. The microemulsion comprises the urea or triazine mixed with t-butyl alcohol, water, oleic acid and ethanolamine. The composition of the Compere patent is disadvantageous because it requires higher levels of urea than are needed to reduce $NO_x$. Moreover, the composition requires higher levels of solubilizing agent to maintain the urea in the composition than are practical or economical. It is expected that a fuel containing the composition would have lower BTU and a lower cetane number/index with resulting disadvantages, such as potentially causing the fuel to be outside of standard specifications. In addition it can be demonstrated that the use of a fuel containing this composition would not be clear or homogeneous at the higher fuel dilutions utilized in the industry.

In addition to the need to provide an improved manner of reducing $NO_x$ and particulate emissions from internal combustion engines, a fuel additive or formulated fuel should be useful in overcoming other problems associated with fuel technology. The additive should be such that the fuel formulation is a stable, homogenous mixture across a broad temperature range. Further, low sulfur and ultra low sulfur diesel fuels presently being manufactured lack lubricity as a result of the low sulfur content of the fuels. Reduced lubricity contributes to engine wear and reduces the distance that the vehicle can travel per unit volume of fuel. It would be desirable for the fuel additive or formulated fuel to improve lubricity in these low and ultra low sulfur fuels.

Moreover, a significant material-handling issue confronting the possible use of non-ionic surfactants in fuel compositions involves the lack of liquidity of many non-ionic surfactants. Specifically, such non-ionic surfactants are present in a gel state when blended with water. Solvents are required to impart the desired viscosity to such surfactant compositions. The addition of solvents adds to the cost of transport and, potentially, may create difficulties in mixing the additive with the fuel. Preferably, therefore, the surfactant should be selected so that the host fuel itself could be used as the solvent. This would permit formulation of a fuel additive concentrate which could be delivered and easily cold splash blended with the host fuel.

An improved fuel additive which, when blended with fuels, would reduce levels of fuel $NO_x$ and particulate emissions when the fuel is burned in an internal combustion engine without materially affecting the BTU content of the fuel, which could be used without mechanical modification of the vehicle, which improves lubricity of the fuel and is easy to formulate and handle would represent an important advance in the art.

OBJECTS OF THE INVENTION

It is an object of this invention to provide improved fuel additives and additive-containing fuels which overcome some of the problems and shortcomings of the prior art.

Another object of this invention is to provide improved fuel additives which, when blended with fuels, provide fuel formulations which produce reduced levels of $NO_x$ emissions when burned in an internal combustion engine.

It is also an object of this invention to provide improved fuel additives which, when blended with fuels, provide fuel formulations which produce reduced levels of particulate emissions when burned in an internal combustion engine.

Still another object of this invention is to provide improved fuel additives which, when blended with fuels, do not materially affect fuel BTU retention.

A further object of the invention is to provide improved fuel additives which, when blended with fuels, provide improved fuel lubricity, particularly in low sulfur and ultra low sulfur fuels.

One other object of this invention is to provide improved fuel additives which, when blended with fuels, permit a vehicle using the fuel to travel further distances per unit volume of fuel.

It is also an object of the invention to provide improved fuel additives which, when blended with fuels, provide stable, homogenous fuel compositions, including at extreme high and low temperatures.

Another object of the invention of the invention is to provide fuel additives which can be supplied in different physical states including, for example, as separate constituents, as an additive, as a concentrate or as a blended finished-form fuel.

One object is to provide an additive which can be formulated to solubilize in the host fuel at any required dilution without phase separation.

An object of the invention is to provide fuel additives which can be added to a wide range of fuels, can be used in spark ignition and diesel engines and can be used in 4-stroke as well as 2-stroke engines.

Yet a further object of the invention is to provide improved fuel additives which are useful in avoiding fuel phase separation, particularly when water is present in the fuel.

Still another object of the invention is to provide improved fuel additives which, when blended with fuels, provide an efficient, cost-effective manner of introducing $NO_x$-reducing compounds to the engine combustion chamber.

An additional object of the invention is to provide improved fuel additives which, when blended with fuels, avoids the need for costly mechanical devices to either introduce $NO_x$-reducing agents to the engine combustion chamber or to treat the post-combustion exhaust stream.

It is an object of the invention is to provide improved fuel additives which are economical to transport.

A further object of the invention is to provide improved fuel additives which can be easily formulated and easily admixed with fuel.

These and other objects of the invention will be apparent from the following descriptions and examples.

SUMMARY OF THE INVENTION

The purpose of this invention is to provide a fuel additive which, when admixed with fuel, provides a manner of delivering a nitrogen-containing compound to the point of combustion in an internal combustion engine as an integral part of the fuel. The additive reduces $NO_x$ emissions from the engine exhaust stream (with or without a trap device), reduces particulate emissions and provides the usual benefits associated with cleaner burning fuels without detriment to performance. Fuel containing the additive is a clear homogenous mixture which advantageously can be introduced directly to the point of combustion through the normal fuel delivery lines thereby avoiding any need for costly mechanical material-feed devices to feed nitrogen-containing compounds to the engine as is typical of the prior art.

The $NO_x$ reducing reagents have utility in many types of fuels including diesel, gasoline, kerosene, alcohol and aqueous-fuel blends. The inventive additive beneficially modifies the boiling point of the fuel in a way expected to improve fuel efficiency. Surprisingly, the invention not only reduces $NO_x$ emissions from the exhaust stream but also enhances the lubricity of the fuel, reducing engine wear and increasing the distance which the vehicle can travel per unit volume of fuel.

The composition can be prepared in different forms based on the needs of the user. These forms include as an additive, concentrate and as a finished form fuel including the additive or concentrate. Preferred forms of the additive include about 3-35% by weight of a nitrogen-containing compound selected from the group consisting of urea, cyanuric acid, triazine, ammonia and mixtures thereof. Urea is the most highly preferred nitrogen-containing compound because of its abundance, low cost and ease of mixing with water. It is preferred that the urea comprises about 10-32% by weight of the additive composition and most highly preferred forms of the invention include 12-28% by weight of urea in the additive form of the invention.

The preferred additive composition further includes about 0.0025-25% by weight of water. When urea is used, the urea is preferably admixed with the water as described herein.

The preferred additive further includes about 30-97% by weight of a carrier blend of non-ionic surfactants provided to solubilize the nitrogen-containing compound in the additive. The preferred carrier blend comprises about 30-75% by weight of an alkoxylated alcohol composition having the following general structure:

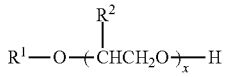

wherein $R^1$ is $C_6$-$C_{16}$, $R^2$ is H or $CH_3$, and x is 1-7. It is preferred that $R^1$ is $C_9$-$C_{11}$ and x is 2.5. Highly preferred forms of the inventive carrier blend useful in practicing the invention include about 33-55% by weight of the alkoxylated alcohol constituent. Mixtures of more than one type of alkoxylated alcohol may be used in a given carrier blend.

The novel carrier blend further includes about 10-60% by weight of a polyalkylene glycol ester composition having the following general structure:

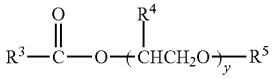

wherein $R^3$ is $C_{11}$-$C_{19}$, $R^4$ is H or $CH_3$, y is 1-20, $R^5$ is H or $COR^3$. Preferably, $R^3$ is $C_{17}$ and $R^5$ is $COR^3$. Polyethylene glycol diesters of oleic acid are highly preferred as are polyethylene glycol ditallates. The preferred polyalkylene glycol ester constituent may include blends of more than one type of polyalkylene glycol ester. More preferred forms of the inventive carrier blend include about 25-40% by weight of the polyalkylene glycol ester constituent while still more preferred embodiments comprise about 25-33% by weight of the polyalkylene glycol ester constituent.

The preferred carrier blend further includes about 10-60% by weight of an alkanolamide composition having the following general structure:

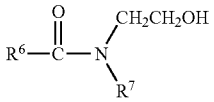

wherein $R^6$ is $C_1$-$C_{18}$, $R^7$ is H or $CH_2CH_2OH$. $R^6$ is preferably $C_{17}$ and $R^7$ is $CH_2CH_2OH$. Oleic acid diethanolamides are highly preferred alkanolamides for use in practicing the invention. The alkanolamide constituent may be provided as a blend of more than one type of alkanolamide. Preferred forms of the invention include about 25-40% by weight of the ethanolamide while 25-33% by weight of the ethanolamide constituent is most highly preferred.

In concentrate forms of the invention the composition includes about 80-20% by weight of the above-described additive together with about 20-80% by weight of a solvent. It is highly preferred that the solvent comprise the host fuel. Highly preferred solvents suitable for use in making the concentrate include diesel, gasoline and kerosene fuels.

In finished form fuel compositions for use in internal combustion engines, the invention includes about 97-99.99% by weight of a hydrocarbon-containing fuel and about 0.01-3% by weight of the above-described fuel additive.

The invention includes the compositions of matter and the method of making each form of the compositions as will be described in more detail below.

As used throughout the specification and claims, terms such as "between 6 and 16 carbon atoms," "C6 to C16" and "$C_{6-16}$" are used to designate carbon atom chains of varying lengths within the range and to indicate that various conformations are acceptable including branched, cyclic and linear conformations. The terms are further intended to designate that various degrees of saturation are acceptable. Moreover, it is readily. known to those of skill in the art that designation of a constituent as including, for example, "$C_{17}$" or "2.5 moles of ethoxylation" means that the constituent has a distribution with the major fraction at the stated average amount or range and, therefore, such a designation does not exclude the possibility that other species exist within the distribution. The constituents of this invention may be isolated or present within a mixture and remain within the scope of the invention.

BRIEF DESCRIPTION OF THE DRAWINGS

The drawings illustrate aspects of preferred embodiments which include the above-noted characteristics and features of the invention. The invention will be readily understood from the descriptions and drawings. In the drawings.

DETAILED DESCRIPTION OF PREFERRED EMBODIMENTS

Figure 1:
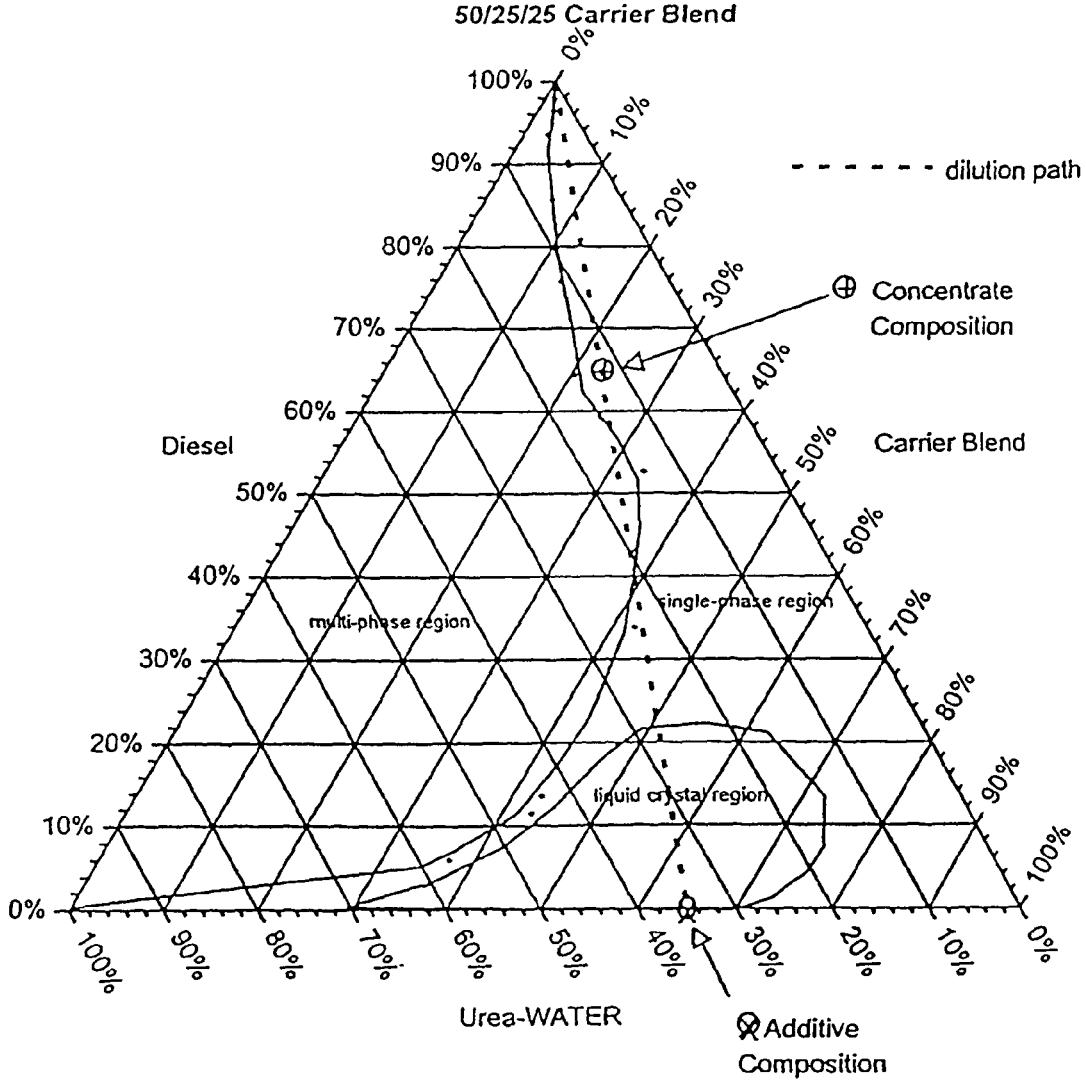
FIG. 1 is a ternary phase diagram showing the solubility of an exemplary additive in fuel according to Examples 1 and 2.

The invention provides a fuel additive for use in internal combustion engines, including diesel and spark ignition engines. The invention may be prepared in various forms including as an additive, concentrate or as a final form fuel. The invention includes the method of making the composition including a fuel including the composition.

The inventive composition is highly effective in solubilizing nitrogen-containing compounds in the fuel. The nitrogen-containing matter enters the engine combustion chamber as part of the fuel and reacts during combustion to reduce $NO_x$ emissions. By providing the nitrogen-containing compound as a component of the host fuel it is possible to avoid any necessity for the use of complex and costly mechanical apparatus used to feed nitrogen-containing compounds to the engine combustion chamber or to the engine exhaust stream.

The invention is powerfully efficacious versus prior art compositions, such as U.S. Pat. No. 5,746,783 (Compere et al.), because less nitrogen is required in the fuel and because far less constituents are required to keep the nitrogen in the fuel, a benefit which provides important cost-savings benefits.

Without wishing to be bound by any particular theory, it is believed that the fuel additive of the invention is effective in producing a stable, single phase additive, concentrate and final form fuel in large part because of the nature of the carrier blend. The nonionic carrier blend is highly efficacious in solubilizing low molecular weight polar nitrogen-containing compounds into non-polar matrices, such as hydrocarbon-containing fuels.

Again, and without wishing to be bound by any particular theory, it is believed that combustion of the nitrogen-containing composition(s) in the fuel within the engine cylinder causes the nitrogen-containing composition to become decomposed and to form reactive species which react with the $NO_x$ emissions. It is thought that the cyanuric acid, triazine and ammonia react to form urea intermediaries which are further decomposed to react with the $NO_x$ emissions. The resultant reactions produce nitrogen gas ($N_2$) and water. By providing the nitrogen-containing composition as an integral component of the fuel, it is possible to continuously maintain the level of the reactive nitrogen-containing composition throughout the combustion process thereby maximizing the amount of $NO_x$ emission reduction.

As summarized above, the nitrogen-containing composition can include urea, cyanuric acid, triazine, ammonia and mixtures thereof. The nitrogen-containing constituent of the additive comprises about 3-35% by weight of the additive. A weight percent range of about 10-32% by weight of the composition is preferred when urea is to be used. The most highly preferred urea is readily available from distributors such as Ashland Distribution Company, Industrial Chemicals and Solvents and Van Waters & Rogers Inc. Manufacturers of urea include Air Products and Chemicals, Inc. and Allied Signal, Inc., Specialty Chemicals. Triazine is manufactured by Arch Chemicals, Inc. Norwalk, Conn. Cyanuric acid is manufactured by GAS Chemicals, Inc. Powell, Ohio. Van Waters & Rogers is a commercial source of ammonia.

The surfactant is provided to form an emulsion in which the nitrogen-containing composition is fully solubilzed in the final fuel formulation. As summarized above, the carrier blend comprises three main surfactant constituents which are broadly described as an alkoxylated alcohol constituent, a polyalkylene glycol ester constituent and an alkanolamide constituent.

The alkoxylated alcohol constituent comprises about 30-75% by weight of the carrier blend composition and preferably comprises about 33-55% of such constituent. Alcohol ethoxylate, and any other alcohol alkoxylated, are prepared by the alkoxylation of any linear or branched alcohol with any commercially available alkaline oxide, for example, ethylene oxide ("EO") or propylene oxide ("PO") or mixtures thereof.

Alkoxylated alcohols suitable for use in the invention are available from Tomah Products, Inc. of 337 Vincent Street, Milton, Wis. 53563 under the trade name Tomadol™. Illustrative Tomadol products include Tomadol 91-2.5 and Tomadol 1-3. Tomadol 91-2.5 is a mixture of C9, C10, and C11 alcohols with an average of 2.5 moles of ethylene oxide per mole of alcohol. The average molecular weight of Tomadol 91-2.5 is reported as 281 and the HLB value (Hydrophyllic/Lipophyllic Balance) is reported as 8.5. Tomadol 1-3 is an ethoxylated C11 (major proportion) alcohol with an average of 3 moles of ethylene oxide per mole of alcohol. The average molecular weight of Tomadol 1-3 is reported as 305 and the HLB value is reported as 8.7. Other alcohol alkoxylates having an HLB of about 8-9 would also be suitable for use in the invention.

Other sources of alkoxylated alcohols include Huntsman Corp., 500 Huntsman Way, Salt Lake City, Utah 84108, Condea Vista Company, 900 Threadneedle St., Houston, Tex. 77079 and Rhodia, Inc., CN 7500, Cranbury, N.J. 08512.

The polyalkylene glycol ester constituent comprises about 10-60% by weight of the carrier blend. More preferred forms of the inventive carrier blend include about 25-40% by weight of the polyalkylene glycol ester constituent while still more preferred embodiments comprise about 25-33% by weight of the polyalkylene glycol ester constituent. The monoester is manufactured through the alkoxylation of a fatty acid (such as oleic acid, linoleic acid, lauric acid, coco fatty acid, tallow fatty acid, myristic acid) with EO, PO or mixtures thereof. The diesters are prepared by the reaction of a polyethylene glycol with 2 equivalents of a fatty acid (for example, oleic acid, linoleic acid, lauric acid, coco fatty acid, tallow fatty acid, myristic acid).

Representative polyalkylene glycol esters useful in practicing the invention include Lumulse brand 62-O, Polyethylene Glycol 600 dioleate and Lumulse 40-O, Polyethylene Glycol 400 monooleate available from Lambent Technologies Inc. of 7247N. Central Park Ave., Skokie, Ill. 60076. Another polyalkylene glycol ester suitable for use in the invention includes Mapeg brand 600-DOT, Polyethylene glycol 600 ditallate from BASF Corporation, Specialty Chemicals, 300 Continental Dr., Mt. Olive, N.J. 17828. Other suppliers of these and related chemicals are Stepan Co., Lonza, Inc. and Goldschmidt, AG 914 Randolph Rd., Hopewell, Va. 23860.

The alkanolamide constituent also comprises about 10-60% by weight of the carrier blend. More preferred forms of the inventive carrier blend include about 25-40% by weight of the alkanolamide constituent while still more preferred embodiments comprise about 25-33% by weight of the alkanolamide constituent. The alkanolamides are generally the reaction products of a mono or diethanolamide with a fatty acid ester.

Alkanolamides suitable for use in the invention are available from McIntyre Group, 24601 Governors Hwy, University park, IL 60466 with the trade name of Mackamide. Examples are Mackamide MO, "Oleamide DEA" and LAM. "Lauramide MEA." Other commercial sources of alkanolamides are Rhodia, Inc. and Goldschmidt AG.

There is no particular order in which the constituents are combined. The method of making the fuel additive composition may preferably include making an aqueous nitrogen-containing composition by admixing about 0.40-50% by weight of the nitrogen-containing compound with about 50-60% by weight of water. Urea is the most preferred type of nitrogen-containing compound for use in the method. A carrier blend is prepared by admixing, in any order, about 30-75 wt. % alkoxylated alcohol, about 10-60 wt. % polyalkylene glycol ester and about 10-60 wt. % alkanolamide constituents. The additive is prepared by admixing about 50-35 wt. % of the aqueous urea composition with about 50-65 wt. % of the carrier blend.

The method of making the fuel additive concentrate includes admixing about 80-20% by weight of the additive form of the composition with about 20-80% of a solvent which is preferably the host fuel. The fuel composition of the invention includes admixing about 0.01-3% by weight of the fuel additive concentrate with about 97-99.99% by weight of fuel.

EXAMPLES

The following examples are provided to further illustrate the invention but are not intended to limit the scope thereof. All parts and percentages are by weight unless otherwise indicated.

Example 1

An exemplary fuel additive according to the invention was prepared. In a 250-ml beaker, the constituents listed in the following table were mixed with a spatula to prepare a 100 gram (50/25/25 wt. %) carrier blend composition:

TABLE 1

Carrier blend Constituents of Example 1

| Constituent | Product I.D. | Amount |
|---|---|---|
| Alcohol ethoxylate | Tomadol 91-2.5 | 50 grams |
| Polyethylene glycol diester of oleic acid | Lumulse 62-O | 25 grams |
| Oleic acid diethanolamide | Comperlan OD | 25 grams |

In a separate 100 ml beaker, 21.5 grams of urea were dissolved in 32.3 grams of water (40 wt. % urea solution). The urea solution was poured into the carrier blend and mixed with a spatula. The resulting fuel-additive was observed to be viscous and in a near gel state. The 153.8 gram fuel additive contained approximately 14% urea by weight.

The additive was added to #2 diesel fuel to obtain a fuel formulation with an additive concentration of 0.225% by weight and a urea concentration of 1 gram/gallon. 7.14 grams of additive were added to 1 gallon (3160 grams) of diesel fuel to achieve the desired 1 gram/gallon urea concentration. The diesel fuel additive solution was stirred vigorously with a mechanical stirrer for 1½ hours at which time complete solubilization was achieved. This process produced a clear stable diesel fuel including the additive.

Example 2

An exemplary fuel additive concentrate according to the invention was prepared. 35 grams of fuel additive of Example 1 were admixed with 65 grams (77.7 ml) of #2 diesel fuel with a spatula in a 250 ml beaker. The gelatinous additive composition was stirred into the diesel fuel and allowed to stand for one hour at which time all the gel particles had dissolved. The resulting concentrate was a clear fluid with a specific gravity of 0.8914. The concentrate contained approximately 4.9% urea and 65% diesel fuel by weight.

The concentrate of this Example was then added to a #2 diesel host fuel to obtain a fuel formulation with an additive concentration of 0.64% by weight and a urea concentration of 1 gram/gallon such as could be used in an internal combustion engine. 20.4 grams of concentrate were added to 1 gallon (3160 grams) of the diesel fuel to achieve the desired 1 gram/gallon urea concentration. The concentrate was a liquid and was not viscous. The concentrate dissolved in the diesel fuel spontaneously without vigorous mixing. This "splash blending" characteristic of this example of the invention represents a significant advantage in that the concentrate mixes easily with the host fuel. As a consequence, the concentrate can be efficiently shipped from the point of manufacture to the refinery for ready mixture with the host fuel.

FIG. 1 is a ternary phase diagram directed to the fuel additive of Example 1 and the concentrate of Example 2. FIG. 1 also illustrates a final form fuel utilizing the compositions of Examples 1 and 2. FIG. 1 graphically illustrates the concentrations at which the compositions of Examples 1 and 2 can be expected to be stable homogenous single phase compositions which would represent ideal fuel additives. FIG. 1 also demonstrates those concentrations at which the compositions can be expected to be unstable multi-phase compositions not suitable for use as a fuel additive.

A ternary diagram is a representation of every possible combination of three components. In this work the three components are: diesel fuel (at the top vertex), the carrier (on the lower right vertex), and 40% urea solution (on the lower left vertex). Thus, a point on the edge halfway between the "carrier" vertex, and the "diesel" vertex would be a 50/50 blend of those two components. A point in the middle of the diagram would be 33.3% of each component. Lines on the ternary chart show phase boundaries between homogeneous and cloudy compositions.

To determine the phase boundaries for such a diagram, a small sample is weighed of a known combination of two of the three components. For example, 0.2 grams of carrier and 0.8 grams of diesel. The test tube is then tared and 40% urea solution is added dropwise with vigorous mixing, until the solution just becomes cloudy. The tube is weighed and the amount of urea solution is calculated. The point in the triangle which corresponds to the known percentage of each of the 3 components is plotted. This process is repeated as many times as necessary, changing the ratio of the first two components each time. The result is a family of points which outline the boundary between single-phase and multi-phase regions of the ternary system.

Liquid crystal regions are found by noting whether the sample becomes viscous and whether it rotates polarized light (by holding the test tube between crossed polarizers). Liquid crystals rotate polarized light.

FIG. 1 represents an analysis of selected combinations of the urea/water, carrier blend and diesel fuel constituents provided in Examples 1 and 2. Each point along the curve represents an actual combination of urea/water, carrier blend and diesel fuel constituents which was tested as part of this invention to determine the boundry between the single phase and multi-phase compositions. All points to the right side of the curve are single phase compositions useful in practicing the invention while compositions to the left side of the curve were determined to be unstable cloudy or multi-phase compositions. The further the curve is to the left, the greater the number of single phase compositions which can be created. The liquid crystal region represents a region where the additive is a stable single phase composition but is more gelatinous.

Optimal compositions useful in practicing the invention can be identified by drawing a straight line from the graph apex (representing 100% fuel) to a point generally tangent to, or to the right side of the curve. Compositions along this line represent optimal maximum levels of nitrogen which can be held in a single phase composition. As shown by the line in FIG. 1, an optimal additive is as described in Example 1 and has a urea/water concentration of about 35% and a carrier blend concentration of about 65%. The ideal concentrate range can be identified at fuel concentrations of about 65%. Example 2 is represented by the 65% fuel concentration. Ideal fuel final form fuel compositions are at 94% or greater amounts of fuel.

Example 3

A further exemplary fuel additive concentrate according to the invention was prepared. In a 400-ml beaker, the constituents listed in following table were admixed with a spatula to prepare a 100 gram (34/33/33 wt. %) carrier blend composition:

TABLE 2

Carrier Blend Constituents of Example 3

| Constituent | Product I.D. | Amount |
|---|---|---|
| Alcohol ethoxylate | Tomadol 91-2.5 | 34 grams |
| Polyethylene glycol ditallate | Mapeg 600-OT | 33 grams |
| Oleic acid diethanolamide | Mackamide MO | 33 grams |

The 100 grams of carrier blend were admixed with 71.5 grams of #2 diesel fuel. The carrier blend dissolved readily in the diesel fuel.

Separately in a 100 ml beaker, 40 grams of water were admixed with 26.7 grams of urea until the urea had dissolved. The aqueous 40 wt. % urea solution was added to the carrier blend/diesel composition. The solution became clear and homogeneous after a few minutes of mixing. The resulting fuel additive concentrate had a viscosity of 435 centipoise at 22° C. as determined with a Brookfield Viscometer with a #3 spindle at 20 rpm. The specific gravity of the concentrate at 20° C. was 0.9632. The concentrate contained 11.2% urea and 30% diesel by weight. Although somewhat viscous, the concentrate is pumpable making the concentrate useful for purposes of handling and transportation.

The concentrate of Example 3 was next added to host diesel fuel to make a final fuel formulation suitable for use in an internal combustion engine. In order to supply 1 gram per gallon of urea in host diesel fuel, 8.9 grams of the concentrate form of Example 3 were added to 1 gallon (3160 grams) of diesel fuel (0.28% concentrate by weight). The concentrate, although somewhat viscous, completely dissolved in the diesel after mixing to become a clear and homogeneous solution.

Example 4

Another fuel additive concentrate according to the invention was prepared. As in Example 3, the constituents listed in following table were admixed with a spatula in a 400 ml beaker to prepare a 100 gram carrier blend composition:

TABLE 3

Carrier Blend Constituents of Example 4

| Constituent | Product I.D. | Amount |
|---|---|---|
| Alcohol ethoxylate | Tomadol 91-2.5 | 34 grams |
| Polyethylene glycol ditallate | Mapeg 600-OT | 33 grams |
| Oleic acid diethanolamide | Mackamide MO | 33 grams |

250 grams of #2 diesel fuel were then added to the carrier blend. The carrier blend dissolved readily in the diesel fuel.

In a separate beaker, 40 grams of water and 26.7 grams of urea were admixed to make an aqueous urea solution. The aqueous urea solution was added to the carrier blend/diesel fuel mixture. The aqueous urea solution dissolved quickly in the carrier blend/diesel solution to produce a clear, homogeneous fuel additive concentrate with a viscosity of less than 40 cps at 22° C. and a specific gravity of 0.9085. The concentrate contained 6.4% urea and 60% diesel by weight.

The concentrate of Example 4 was added to host diesel fuel to make a final fuel formulation suitable for use in an internal combustion engine. In order to supply 1 gram per gallon of urea in diesel fuel, 15.6 grams of the concentrate were added to 1 gallon (3160 grams) of diesel fuel to reach an additive concentration of 0.49% concentrate by weight. The fluid concentrate advantageously dissolved quickly in the diesel fuel with almost no mixing. As with the other examples, the ease of blending of the concentrate with the host fuel makes it possible to manufacture the concentrate at a site remote from the refinery and to easily transport the composition to the refinery for splash blending with the host fuel to form a final form fuel.

Figure 2:
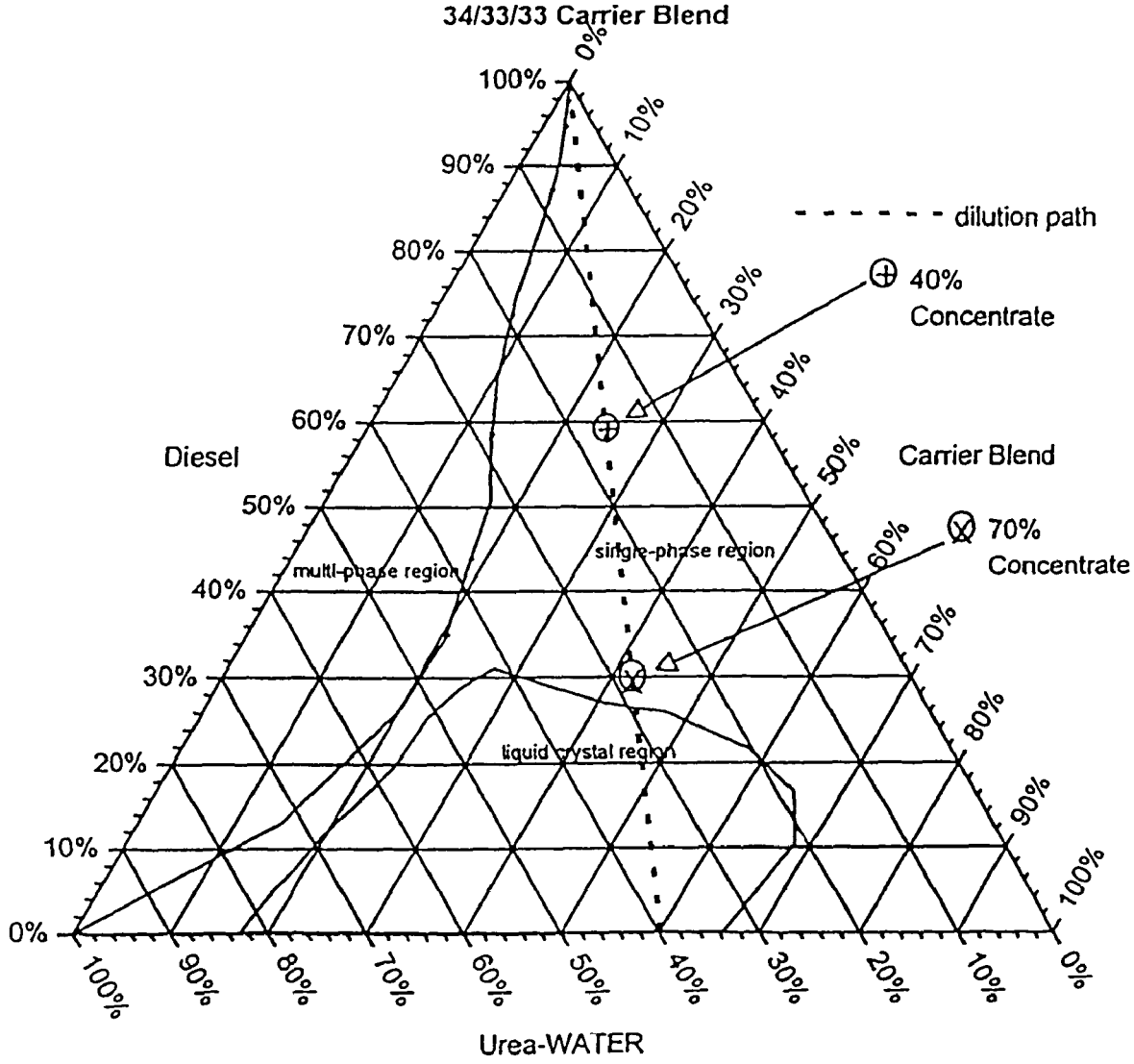
FIG. 2 is a ternary phase diagram showing the solubility of an exemplary additive in fuel according to Example 3.

FIG. 2 represents an analysis of selected combinations of the urea/water, carrier blend and diesel fuel constituents provided in Examples 3 and 4. Each point along the curve and along the dilution path represents an actual combination of urea/water, carrier blend and diesel fuel constituents which was tested as part of this invention to determine the point at which the composition was a multi-phase or single-phase composition. All points to the right side of the curve are single phase compositions useful in practicing the invention. FIG. 2 demonstrates that there are many optimal stable and homogenous additive, concentrate and final form fuel combinations which may be prepared using the novel composition. Further, the data show that the composition of the invention is highly efficacious in solubilizing large amounts of the nitrogen-containing compound per unit volume of carrier blend.

Figure 3:
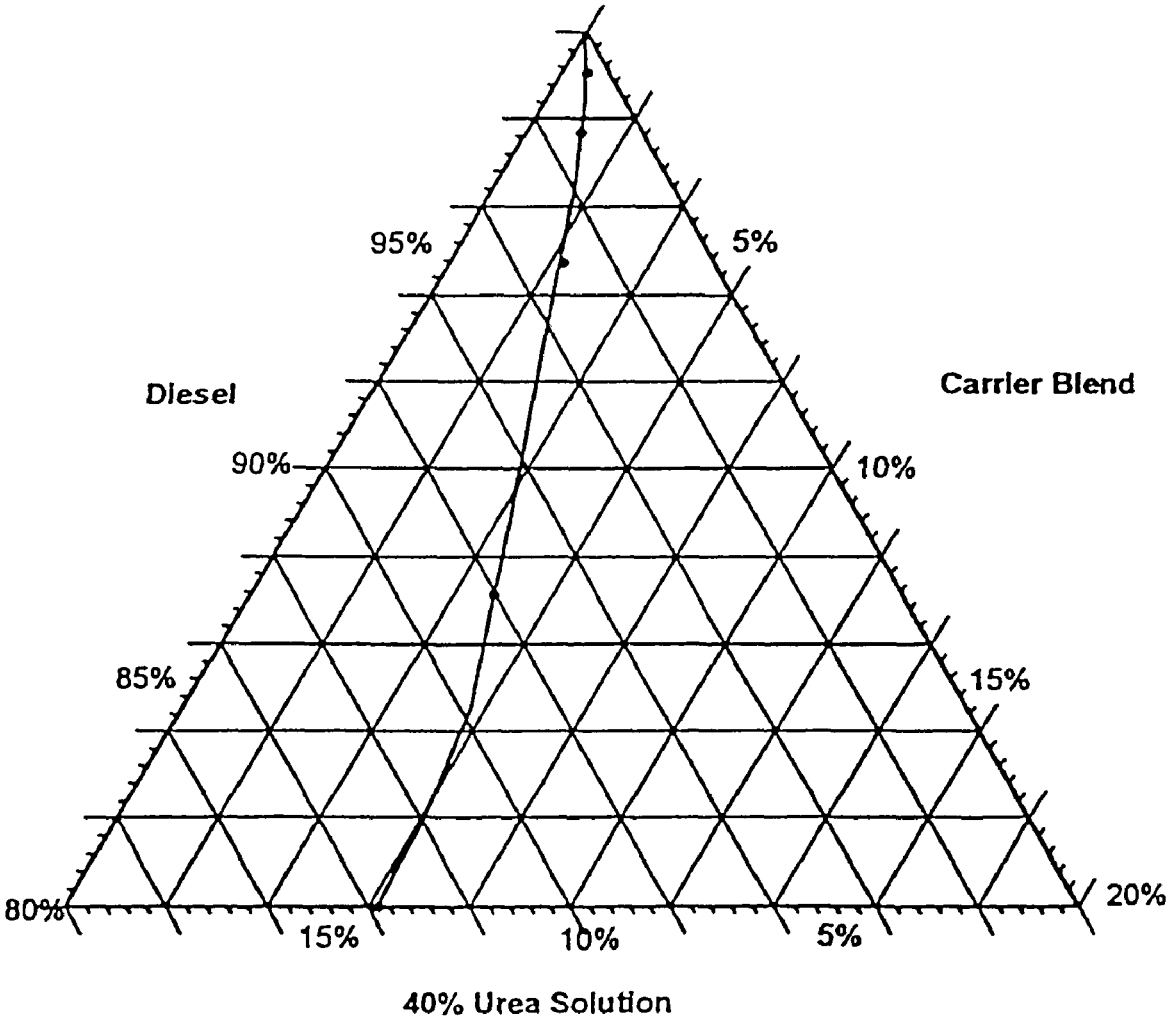
FIG. 3 is a ternary phase diagram showing a portion of FIG. 2 in which the diesel fuel is present in an amount of 80% or greater of the composition of Example 3.

FIG. 3 represents the upper portion of FIG. 2 and shows in greater detail the properties of the composition of Examples 3 and 4 including 80% or greater amounts of the diesel fuel. FIG. 3 demonstrates that the composition is stable and homogenous in final form fuel compositions having fuel concentrations of between about 80-99.99. %.

Example 5

A fuel additive composition incorporating a C11 alcohol ethoxylate with 3 moles of EO was prepared. As in Example 4, the constituents listed in following table were admixed with a spatula in a 400 ml beaker to prepare a 100 gram (34/33/33 wt. %) carrier blend composition:

TABLE 4

Carrier Blend Constituents of Example 5

| Constituent | Product I.D. | Amount |
|---|---|---|
| Alcohol ethoxylate | Tomadol 1-3 | 34 grams |
| Polyethylene glycol ditallate | Mapeg 600-OT | 33 grams |
| Oleic acid diethanolamide | Mackamide MO | 33 grams |

The 100 gram carrier blend composition was admixed with 250 grams of #2 diesel fuel whereupon the carrier blend was observed to dissolve readily in the diesel fuel.

In a separate beaker, 40 grams of water and 26.7 grams of urea were admixed to make an aqueous 40 wt. % urea solution. The aqueous urea solution was added to the carrier blend/diesel fuel mixture. Once again the aqueous urea solution dissolved quickly in the carrier blend/diesel solution to produce a clear, homogeneous fuel additive concentrate with a viscosity of less than 40 cps at 22° C. and a specific gravity of about 0.9085. The concentrate contained 6.4% urea and 60% diesel by weight.

The concentrate of Example 5 was added to host diesel fuel to make a final fuel formulation suitable for use in an internal combustion engine. 15.6 grams of the concentrate were added to 1 gallon (3160 grams) of diesel fuel to reach an additive concentration of 0.49% concentrate by weight and 1 gram of urea per gallon of diesel fuel. The fluid concentrate advantageously dissolved quickly in the diesel fuel with almost no mixing. The composition of Example 4 would be easily pumpable.

Figure 4:
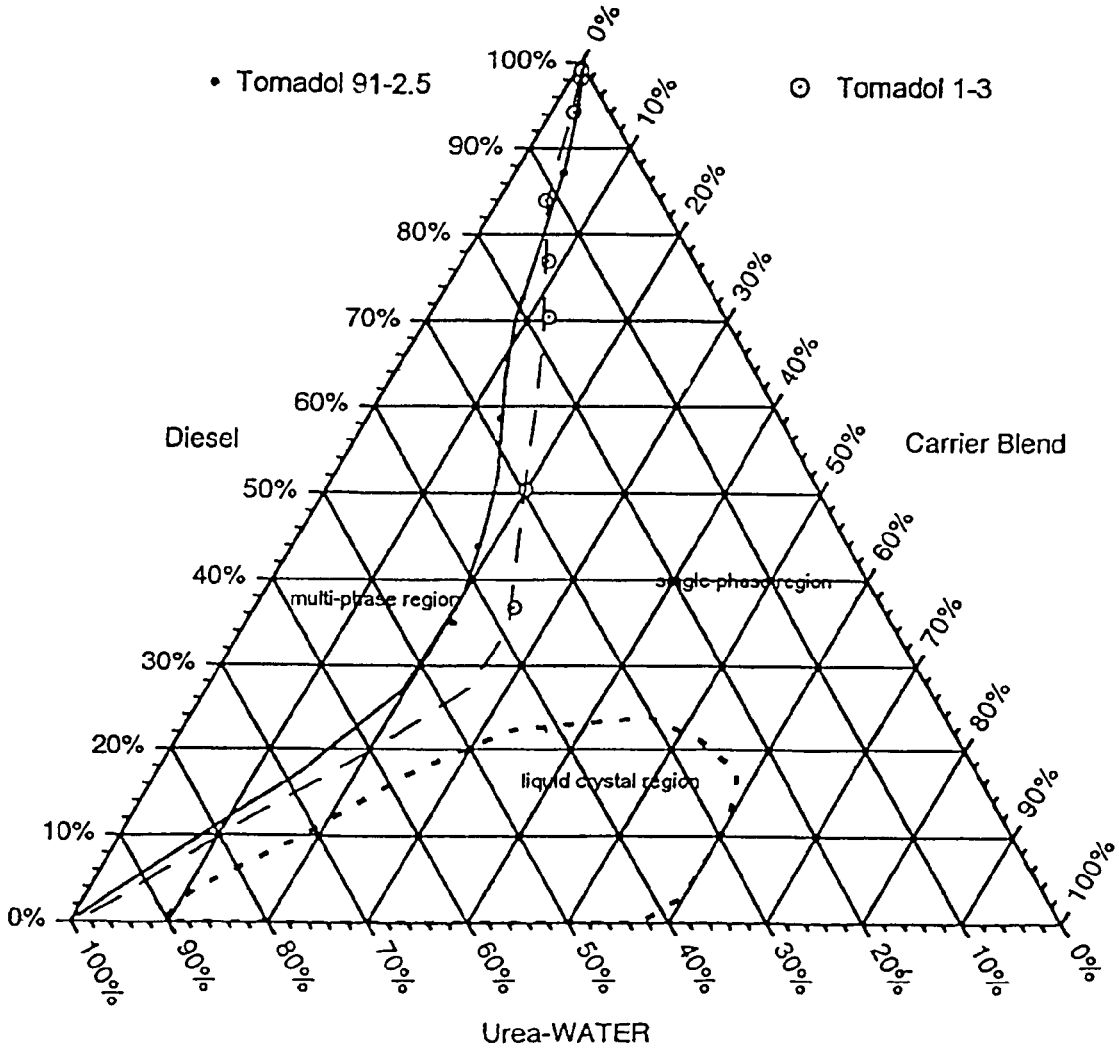
FIG. 4 is a ternary phase diagram showing the solubility of an exemplary additive in fuel according to Example 5.

FIG. 4 is the ternary phase diagram showing the constituent concentrations at which the composition of Example 5 is a stable homogenous single phase composition. The composition of Examples 3 and 4 is also shown on FIG. 4 by the solid line as a basis of comparison. FIG. 4 demonstrates that the composition of Example 5 is stable when the additive form of the invention has a urea/water concentration of less than about 56%. The concentrate is stable at about 30-70% fuel and about 52%.

Example 6

An exemplary fuel additive composition according to the invention was prepared. The exemplary composition was prepared using a branched alcohol ethoxylate.

Table shows the constituents used to prepare the carrier blend of Example 6.

TABLE 5

Carrier Blend Constituents of Example 6

| Constituent | Product I.D. | Amount |
|---|---|---|
| Iso C10 alcohol + 2.5 Moles EO. | Not applicable | 34 grams |
| Polyethylene glycol ditallate | Mapeg 600-OT | 33 grams |
| Oleic acid diethanolamide | Mackamide MO | 33 grams |

The alcohol ethoxylate for Example 6 was prepared using Exxal-10 which is an Iso C10 alcohol available from Exxon-Mobil. The branched alcohol was alkoxylated with 2.5 moles of EO per mole of alcohol.

The composition of Example 6 was prepared in the same manner as Examples 3-5. The three constituents listed in Table 5 were admixed with a spatula in a 400 ml beaker to prepare a 100 gram (34/33/33 wt. %) carrier blend composition. 250 grams of #2 diesel fuel were then added to the carrier blend. The carrier blend dissolved readily in the diesel fuel.

In a separate beaker, 40 grams of water and 26.7 grams of urea were admixed to make an aqueous 40 wt. % urea solution. The aqueous urea solution was added to the carrier blend/diesel fuel mixture. The aqueous urea solution dissolved quickly in the carrier blend/diesel solution to produce a clear, homogeneous fuel additive concentrate with a viscosity of less than 40 cps at 22° C. and a specific gravity of 0.9085. The concentrate contained 6.4% urea and 60% diesel by weight.

The concentrate of Example 6 was added to host diesel fuel to make a final fuel formulation suitable for use in an internal combustion engine. In order to supply 1 gram per gallon of urea in diesel fuel, 15.6 grams of the concentrate were added to 1 gallon (3160 grams) of diesel fuel to reach an additive concentration of 0.49% concentrate by weight. The fuel appeared to be homogenous without any phase separation.

Figure 5:
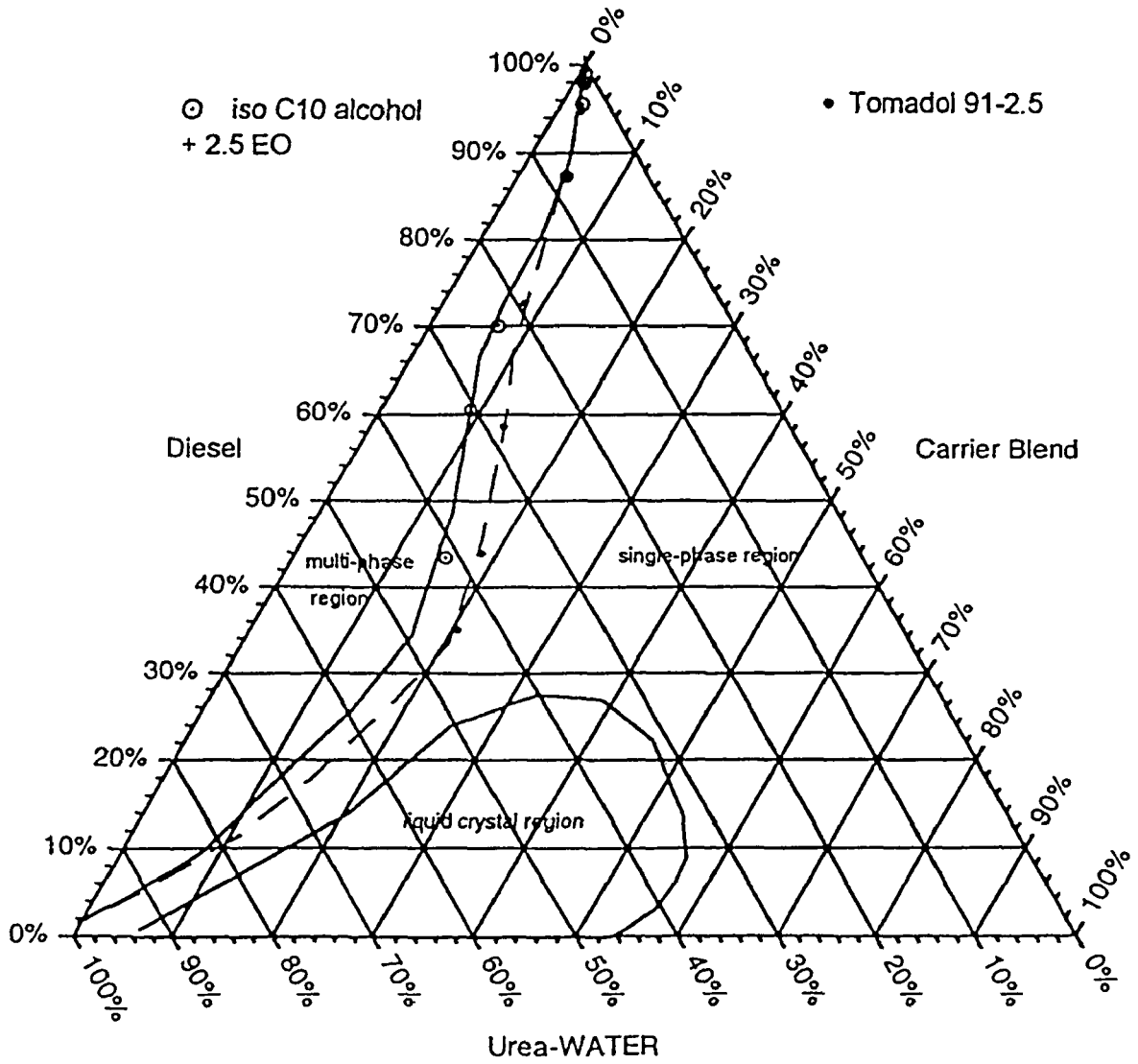
FIG. 5 is a ternary phase diagram showing the solubility of an exemplary additive in fuel according to Example 6.

FIG. 5 is a ternary phase diagram showing data points representing actual compositions of Example 6 which were evaluated to determine those compositions which were stable homogenous single phase composition. The composition of Examples 3 and 4 is also shown on FIG. 4 by the dotted line. FIG. 5 demonstrates that the additive composition of Example 6 is stable at urea/water concentrations of about 76% or less. The concentrate is stable at fuel concentrations of 20-80 wt. % with between about 4-28 wt. % of urea.

Example 7

Example 7 was prepared to demonstrate the efficacy of the invention in gasoline. The composition was prepared according to Example 4 including a carrier blend made up of the constituents shown in Table 6 below:

TABLE 6

Carrier Blend Constituents of Example 7

| Constituent | Product I.D. | Amount |
|---|---|---|
| Alcohol ethoxylate | Tomadol 91-2.5 | 34 grams |
| Polyethylene glycol ditallate | Mapeg 600-OT | 33 grams |
| Oleic acid diethanolamide | Mackamide MO | 33 grams |

The 100 grams of carrier blend constituents were admixed with a spatula in a 400 ml beaker to prepare a 100 gram (34/33/33 wt. %) carrier blend composition. 250 grams of 87 octane commercial regular grade Mobil gasoline were then added to the carrier blend. The carrier blend dissolved readily in the gasoline.

In a separate beaker, 40 grams of water and 26.7 grams of urea were admixed to make an aqueous urea solution. The aqueous urea solution was added to the carrier blend/gasoline mixture. The aqueous urea solution dissolved quickly in the carrier blend/gasoline solution to produce a clear, homogeneous fuel additive concentrate. The composition was observed to have a low viscosity and would be easy to pump and handle. The concentrate contained 6.4% urea and 60% gasoline by weight.

Figure 6:
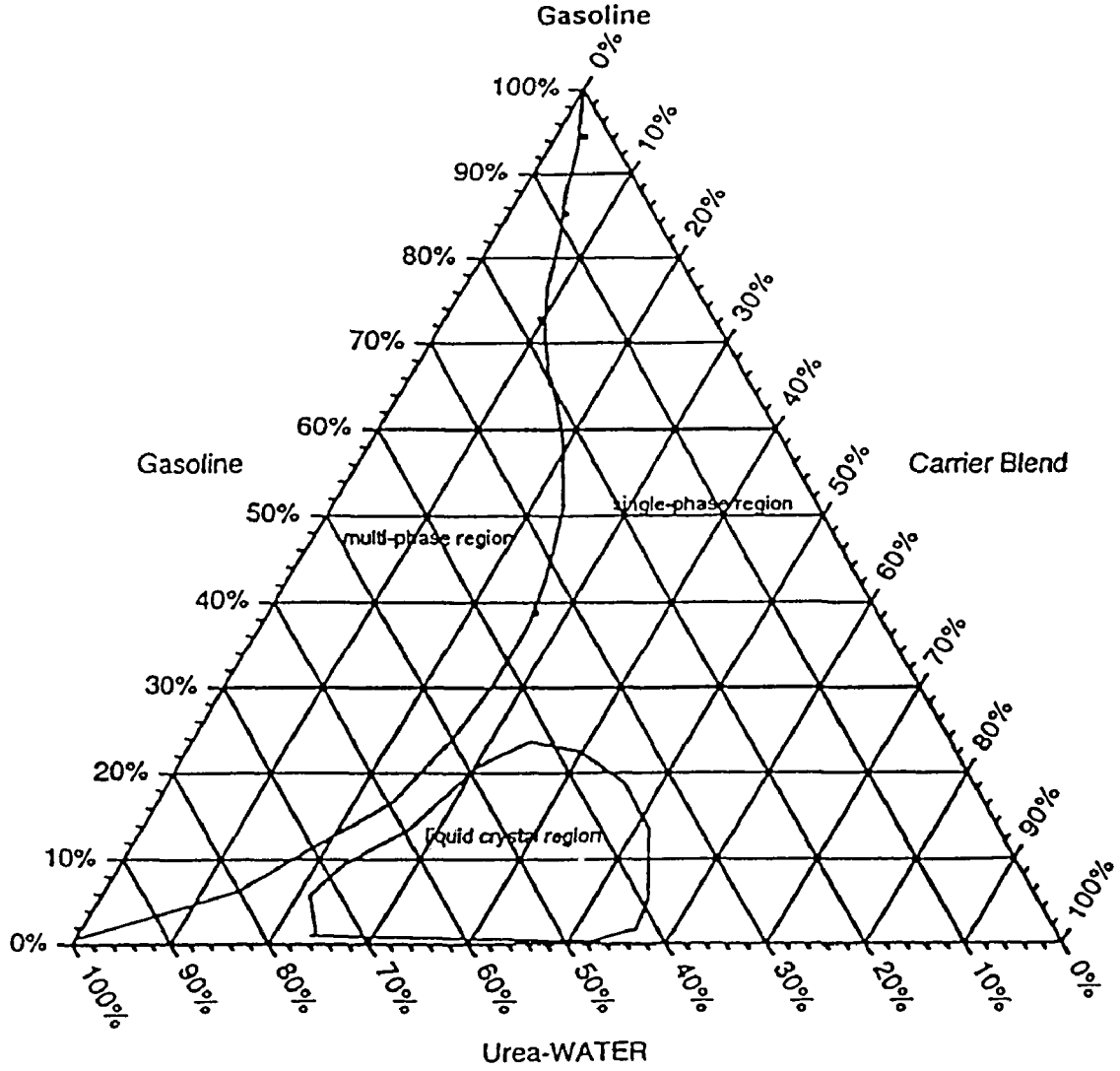
FIG. 6 is a ternary phase diagram showing the solubility of an exemplary additive in fuel according to Example 7.

FIG. 6 represents an analysis of selected combinations of the urea/water, carrier blend and gasoline of Example 6. The data points represent actual compositions of Example 6 which were prepared and evaluated at the fuel, urea/water and carrier blend concentrations shown on the drawing. The data show that the formulation of the invention and the gasoline forms a stable, homogenous composition across a wide range of concentrations.

Example 8

An evaluation of U.S. Pat. No. 5,746,783 (Compere et al.) was conducted. The Compere patent provides a number of examples in which "microemulsions" of urea and water are said to be formed in diesel fuel using a combination of t-butanol, oleic acid, and monoethanolamine as the carrier. In Compere's Example 7, 20 grams of urea, 100 grams of water, 100 grams of t-butanol, 180 grams of oleic acid, and 20 grams of monoethanolamine were combined with 1580 grams of diesel fuel to provide a fuel for testing. This combination contains 1% urea, 15% carrier and 79% diesel with the balance being water. This is equivalent to about 33 grams of urea per gallon of fuel/carrier/water, considerably more urea than has been found effective for NOx reduction.

Figure 7:
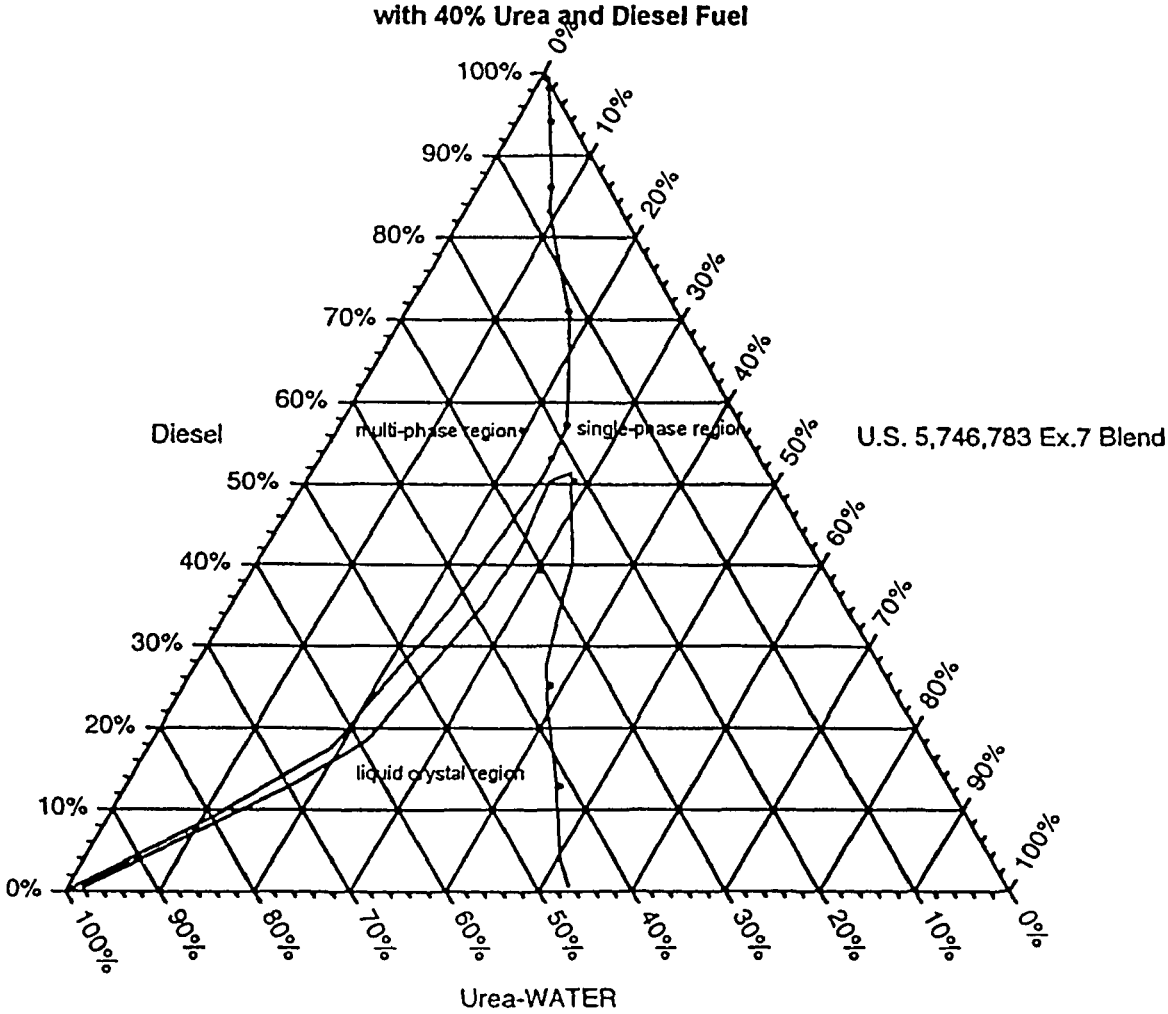
FIG. 7 is a ternary phase diagram showing the solubility of an additive.
Figure 8:
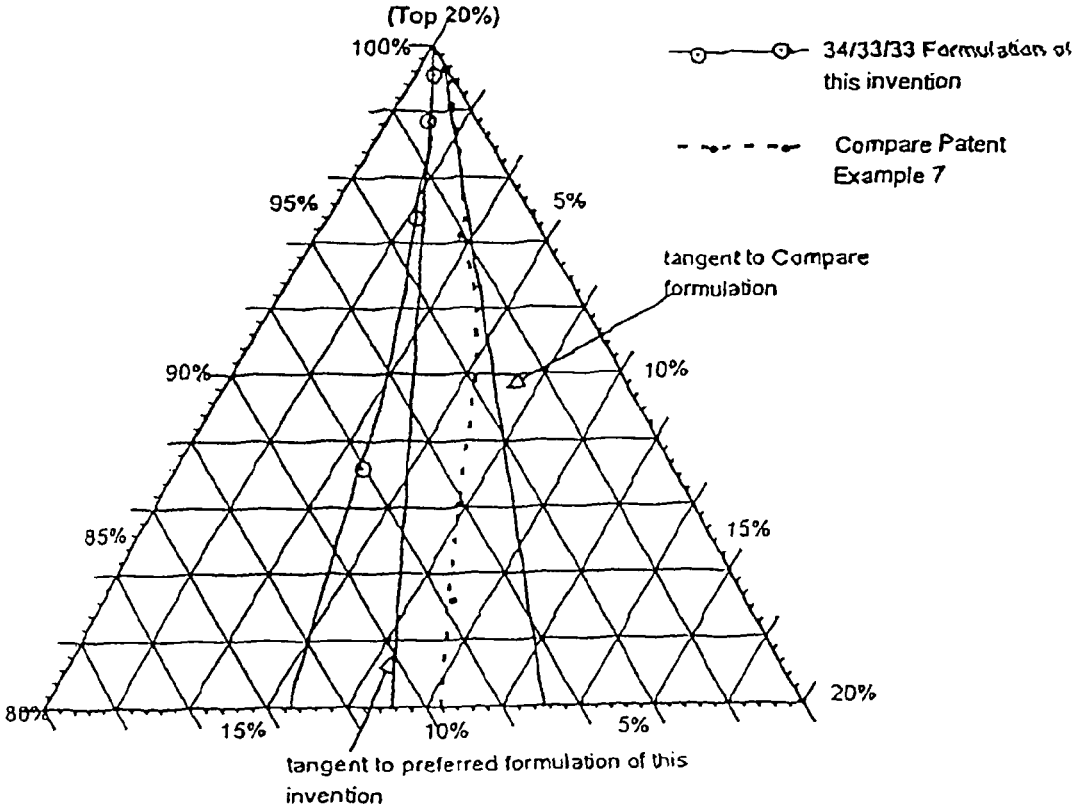
FIG. 8 is a ternary phase diagram showing a portion of FIG. 7.

FIGS. 7 and 8 are ternary phase diagrams of the Compere composition plotted in order to relate it to the compositions of our invention. The combination of 100 grams of t-butanol, 180 grams of oleic acid, and 20 grams of monoethanolamine was used as the carrier with a 40% solution of urea in water.

The results are shown in FIG. 7. Evaluation of FIG. 7 shows a considerably smaller single-phase region than are obtained with the preferred compositions of our invention as shown in the previous examples.

FIG. 8 is an enlarged drawing of the upper portion of FIG. 7. In this figure it can be seen that in the most dilute part of the phase diagram the formulation from Compere Example 7 does not permit dilution below about 0.5% additive. The tangent to the phase boundary at low concentrations shows that the maximum fraction of urea solution in the additive is 7/20.

The tangent to the phase boundary of the preferred formulation from our invention (also shown in FIG. 8) allows a maximum fraction of urea solution in the additive of 11/20.

Other examples in Compere et al. use even higher amounts of urea per gallon of diesel fuel, without any data to substantiate better performance in the engine.

Therefore, the present invention efficaciously requires less carrier blend to keep more nitrogen-containing compound in solution than is the case with Compere. As a result, the calorific content of the inventive fuel and the air/fuel ratio required for the inventive fuel will be closer to the manufacturer's specification.

Example 9

A blend of urea and water was heated to above 40° C. to produce a clear solution. This solution was then added to an ethoxylated fatty acid and added to a combination of diethanolamide and a higher alcohol ethoxylate. The resulting composition was a stable clear solution when added to diesel. The composition was temperature tolerant from −10° C. to 90° C.

Example 10

An exemplary fuel additive of the invention was evaluated for lubricity. Additive lubricity is an important property because ultra low sulfur gasoline presently used in many areas disadvantageously has reduced lubricity because of the reduced sulfur content. Decreased fuel lubricity results in increased wear on engine parts and reduces engine efficiency decreasing the distance that the vehicle can travel per unit volume of fuel. Any measurable increase in lubricity provided by a fuel additive would represent an advantage.

The concentrate for use in the lubricity evaluations was prepared on a volume percent basis. The carrier blend (50/25/25 vol. %) consisted of the following constituents prepared according to the volume percentages shown in Table 7 below:

TABLE 7

Carrier Blend Constituents of Example 10

| Constituent | Volume % |
|---|---|
| Alcohol ethoxylate C9-C11 (Shell Chemical Co.) alcohol + 2.5 moles EO | 50 |
| Polyethylene glycol (7 mole ethoxylate) mono & dioleate blend (1:1 vol. % ratio) | 25 |
| Lauric diethanolamide | 25 |

A solution of 60. % water and 40% urea was prepared and admixed with the carrier blend on a 1:1 volume basis to form the additive for use in the lubricity evaluation. The resulting gel was dispersed in gasoline.

Ultra low sulfur European reference gasoline (RF08A85) was utilized for the lubricity evaluation. Each fuel sample was blended with the weight percentage of additive shown in Table 8 below.

The fuel samples were then tested for lubricity according to ASTM standard D6079-99 Standard Test Method for Evaluating Lubricity of Diesel Fuels by the High-Frequency Reciprocating Rig (HFRR). The HFRR test measures wear on a reference part coated with the fuel. The greater the amount of wear on the part, the less lubricity provided by the fuel. The lubricity data is as follows:

TABLE 8

Lubricity Data -- RF08A85 Gasoline Formulations

| Sample # | 1 | 2 | 3 |
|---|---|---|---|
| Additive (wt. %) | 0.000 | 0.093 | 0.375 |
| Lubricity (Part wear in μ) | 670 | 276 | 234 |

The data show that the inventive composition provides a significant reduction in wear and increase in lubricity versus unmodified reference fuel. It is believed that this improvement in lubricity will cause an increase in engine efficiency and a resultant reduction in emissions and increase in the distance that the vehicle can travel per unit volume of fuel.

Example 11

The inventive fuel additive was next evaluated to determine the effect of the additive on the distillation of ultra low sulfur European reference gasoline (RF08A85). Reduction of the gasoline fuel boiling range is an indication that the composition will burn more completely in the engine. More complete combustion produces fewer emissions (having decreased $NO_x$ emissions) and results in more efficient operation of the engine. See e.g., U.S. Pat. No. 6,030,521 (Croudace et al.) which asserts that a reduction in distillation temperature increases engine efficiency.

Three 1 L samples of the reference gasoline were obtained. Additive as described in Example 10 was prepared and added to the three gasoline samples in the weight percentages shown in Table 9 below.

The three gasoline samples were distilled according to British Institute of Petroleum Standard IP 123. According to the IP 123 standard, the fuels were heated at atmospheric pressure to a final temperature of approximately 200° C. The temperature at which predetermined fractions of the fuel were recovered was measured and recorded. A greater recovery of distilled fuel at lower temperatures is an indication that the fuel boiling point has been reduced and is a further indication that the fuel will burn at a lower temperature with the resultant emission-reduction and efficiency benefits. A small temperature difference represents a potentially significant improvement in fuel efficiency. The fuel distillation data is as follows:

TABLE 9

Distillation Data -- RF08A85 Gasoline Formulations

| Sample # | 1 | 2 | 3 |
|---|---|---|---|
| Additive (wt. %) | 0 | 0.093 | 0.375 |
| Initial B.P. ° C. | 36 | 35 | 35 |
| 5% Recovered ° C. | 51 | 49 | 49 |
| 10% Recovered ° C. | 57 | 55 | 55 |
| 20% Recovered ° C. | 65 | 64 | 64 |
| 30% Recovered ° C. | 76 | 75 | 74 |
| 40% Recovered ° C. | 88 | 87 | 87 |
| 50% Recovered ° C. | 100 | 100 | 99 |
| 60% Recovered ° C. | 110 | 112 | 110 |
| 70% Recovered ° C. | 120 | 120 | 119 |
| 80% Recovered ° C. | 136 | 135 | 133 |
| 90% Recovered ° C. | 180 | 179 | 176 |
| 95% Recovered ° C. | 196 | 195 | 189 |
| Final Temp. ° C. | 202 | 202 | 200 |
| Vol. % Residue remaining | 1.0 | 1.0 | 1.0 |

The gasoline distillation data demonstrates that an exemplary additive according to the invention reduces the fuel boiling point and increases the percent fuel recovered at a lower temperature. It is expected that this property of the additive will result in better combustion characteristics and in reduced emission production.

Example 12

The inventive fuel additive was next evaluated for lubricity in ultra low sulfur European reference diesel fuel (RF73A93) according to ASTM standard D6079-99. An additive composition according to Example 10 was prepared. The additive was added to five of six diesel fuel samples in the weight percent amounts shown in Table 10. The diesel fuels were then evaluated for lubricity according to the ASTM standard. The lubricity results are as follow:

TABLE 10

Lubricity Data -- RF73A93 Diesel Formulations

| Sample # | 1 | 2 | 3 | 4 | 5 | 6 |
|---|---|---|---|---|---|---|
| Additive (wt. %) | 0 | 0.436 | 0.435 | 0.855 | 0.927 | 0.691 |
| Lubricity (wear in μ) | 376 | 306 | 269 | 307 | 296 | 288 |

Part wear is decreased in all samples including the additive of the invention. The data demonstrate that the additive composition is useful in increasing fuel lubricity with the resultant engine and vehicle operation benefits.

Example 13

The inventive fuel additive was next evaluated to determine the effect of the additive on the distillation of the European reference low sulfur diesel fuel (RF73A93). Six diesel fuel compositions were prepared as in Example 12. The fuel additive for use in Example 13 was prepared as in Example 10. The weight percent of fuel additive added to each diesel fuel sample is shown in Table 11 below.

The diesel fuel samples were distilled according to British Institute of Petroleum Standard IP123. The six 1 L diesel fuel samples were heated to a final temperature of approximately 367° C. The temperatures at which predetermined fractions of the diesel fuels were recovered were measured and recorded in Table 11 below. The diesel fuel distillation data is as follows:

The data show that the inventive additive is effective in reducing the boiling point of the diesel fuel and in increasing the amount of fuel collected at lower temperatures. Sample 5, the diesel fuel composition with the largest additive concentration, demonstrated the most notable modification to the host fuel boiling point and vapor pressure. These data demonstrate that a small concentration of additive is effective in modifying the distillation properties of the host fuel.

Example 14

The inventive fuel additive was next evaluated to determine the effect of the additive on reduction of $NO_x$ and particulate emissions and on the overall efficiency of the fuel in terms of the vehicle travel distance per unit volume of fuel. The evaluation was conducted by evaluating the performance of an engine operated using fuel compositions including varying concentrations of the inventive additive and against reference fuels not including the additive.

A Cummins engine was subjected to a dynamometer test at four different operation modes to evaluate base fuel against various fuels including an exemplary additive of the invention. The engine used for the example was a Cummins 855 CI 4 stroke turbo charged, intercooled diesel engine. The engine was coupled to a SuperFlow Engine Dynamometer Model SF3100 rated at 1500 HP. A SuperFlow Advanced Test Console was used to record the dynamometer data.

A Sierra Micro Dilution Test Stand System Model BG-2 for Particulate Matter was utilized to measure particulate emissions. This fully computerized Micro-Dilution system is used to evaluate any size engine for particulate emissions and produces repeatable values that correlate with full dilution Systems over a wide variety of steady state conditions as defined by ISO 8178-4 or by CARB.

The test apparatus measured emissions at varying engine speeds (in RPM) and torque. $NO_x$ emissions were determined with a Model 951 Beckman Chemiluminescence $NO/NO_x$ Analyzer and a Model 3400 Milton Roy Nondispersive Infrared CO & $CO_2$ Gas Analyzer was used to measure CO emissions. A J.U.M. Engineering Heated Flame Ionization Total Hydrocarbon Analyzer Model VE 7 was used to measure hydrocarbon emissions and oxygen emissions were taken with a Teledyne Analytical Instruments Oxygen Detector. A Wager Light Extinction Opacity Meter Model 650 A was used

TABLE 11

Distillation Data -- RF73A93 Diesel Formulations

| Sample # | 1 | 2 | 3 | 4 | 5 | 6 |
|---|---|---|---|---|---|---|
| Additive (wt. %) | 0 | 0.436 | 0.435 | 0.855 | 0.927 | 0.691 |
| Initial B.P. ° C. | 216 | 100 | 101 | 200 | 198 | 214 |
| 5% Recovered ° C. | 235 | 221 | 224 | 220 | 212 | 227 |
| 10% Recovered ° C. | 243 | 234 | 229 | 230 | 224 | 237 |
| 20% Recovered ° C. | 254 | 251 | 245 | 243 | 244 | 251 |
| 30% Recovered ° C. | 264 | 261 | 258 | 257 | 257 | 262 |
| 40% Recovered ° C. | 274 | 270 | 266 | 267 | 267 | 271 |
| 50% Recovered ° C. | 282 | 279 | 277 | 276 | 275 | 279 |
| 60% Recovered ° C. | 290 | 290 | 286 | 284 | 283 | 287 |
| 70% Recovered ° C. | 301 | 300 | 300 | 295 | 293 | 300 |
| 80% Recovered ° C. | 314 | 314 | 312 | 308 | 307 | 312 |
| 90% Recovered ° C. | 328 | 334 | 333 | 328 | 326 | 333 |
| 95% Recovered ° C. | 357 | 346 | 347 | 350 | 346 | 347 |
| Final Temp. ° C. | 367 | 349 | 352 | 358 | 356 | 352 |
| Vol. % Residue remaining | 2.2 | 3.3 | 3.0 | 2.0 | 1.5 | 2.0 |

to measure particulate emissions. The particulate emissions referred to are typically pm10-designated components which reside in the black smoke discharged as the diesel engine exhaust.

The four engine modes used for the engine dynamometer tests each represented a different operation condition of a motor vehicle. The modes are as follows:

TABLE 12

| Engine Dynamometer Modes | | |
|---|---|---|
| Mode | Torque | Engine Speed (RPM) |
| Mode 1 | Idle | Idle |
| Mode 2 | Maximum | Int. Speed |
| Mode 3 | Rated | Rated |
| Mode 4 | 50% Rated | Rated |

Mode 1 represents an engine which is in an idle condition. Mode 1 is an important mode with respect to production of emissions because a significant amount of engine operation occurs in the idle mode, particularly with respect to buses and heavy duty trucks. It is estimated, for example that approximately 30% of bus engine operation is conducted in the idle mode.

Mode 2 simulates conditions of heavy vehicle load. Modes 3 and 4 represent driving conditions.

The fuel additive for use in the engine tests was again prepared according to Example 10. The fuel additive was then blended with the CARB spec. number 2 diesel fuel to form 8 fuel formulations for use in the engine evaluation. The fuel additive was added to the reference fuel to achieve the weight percent fuel additive concentrations shown in Table 13 below. In Table 13, "HC" and "CO" refer to hydrocarbon and carbon monoxide emissions respectively and "PM" refers to the engine particulate emissions.

Fuel formulations including the additive showed advantageous reductions in $NO_x$ and other particulate emissions in all four test modes. In mode 1, the idle mode, the fuel formulations including the additive of the invention produced, on average, 21.54% fewer $NO_x$ emissions versus the reference fuels. At least one fuel formulation (sample 4) achieved a 38.78% decrease in $NO_x$ emissions versus the unmodified fuel. There was no measurable difference in particulate emissions between samples 3 and 5.

In mode 2, fuel formulations including the inventive additive produced, on average, 15.31% fewer $NO_x$ emissions. Sample 4 achieved a 20.51% reduction in $NO_x$ emissions versus unmodified fuel. Particulate emissions were reduced about 37% in this high-torque mode.

In mode 3, the percent reduction in $NO_x$ emissions averaged 6.78% versus the unmodified fuels. Particulate emissions were reduced about 46% in mode 3. Sample 4 produced 10.16% less $NO_x$ emissions than the average of the unmodified fuels.

The mode 4 results demonstrated that the composition of the invention was effective in reducing $NO_x$ emissions by an average of 3.48% versus the average of the unmodified fuels. Particulate emissions were reduced about 28% in mode 4 versus the fuel composition which did not include the additive. Sample 4 reduced $NO_x$ emissions by 5.68% versus the average $NO_x$ production of the unmodified fuels. In an environment, such as an urban environment, reduction of $NO_x$ and other emissions by the amounts in engine evaluation data would represent a significant improvement in air quality.

While the principles of this invention have been described in connection with specific embodiments, it should be understood clearly that these descriptions are made only by way of example and are not intended to limit the scope of the invention.

TABLE 13

| Engine Emission Evaluation | | | | | | | | |
|---|---|---|---|---|---|---|---|---|
| Sample # | 1 | 2 | 3 | 4 | 5 | 6 | 7 | 8 |
| Carb D Fuel Formulations | | | | | | | | |
| Additive (wt. %) | 0.00 | 0.00 | 0.00 | 0.317 | 0.435 | 0.691 | 0.855 | 1.049 |
| Mode 1 | | | | | | | | |
| HC (gph) | 36.72 | 34.04 | 32.60 | 32.28 | 35.74 | 32.88 | 30.86 | 28.82 |
| CO (gph) | 45.85 | 41.44 | 41.07 | 40.57 | 43.84 | 39.65 | 37.43 | 33.69 |
| NOx (gph) | 86.06 | 76.37 | 72.62 | 68.52 | 60.54 | 66.17 | 59.46 | 52.69 |
| PM (gph) | * * * | * * * | 4.8 | * * * | 4.8 | * * * | * * * | * * * |
| Fuel used (gph) | 2910.00 | 2595.00 | 2745.00 | 2850.00 | 3180.00 | 2745.00 | 2895.00 | 2565.00 |
| Mode 2 | | | | | | | | |
| HC (g/bhph) | 0.10 | 0.10 | 0.11 | 0.10 | 0.11 | 0.09 | 0.10 | 0.10 |
| CO (g/bhph) | 0.48 | 0.42 | 0.41 | 0.45 | 0.44 | 0.45 | 0.40 | 0.39 |
| NOx (g/bhph) | 0.78 | 0.77 | 0.78 | 0.69 | 0.66 | 0.62 | 0.67 | 0.65 |
| PM (g/bhph) | * * * | * * * | 0.037 | * * * | 0.027 | * * * | * * * | * * * |
| Fuel used (g/bhph) | 310.18 | 127.79 | 126.67 | 127.47 | 131.31 | 126.75 | 130.21 | 128.37 |
| Mode 3 | | | | | | | | |
| HC (g/bhph) | 0.11 | 0.11 | 0.10 | 0.10 | 0.11 | 0.10 | 0.10 | 0.10 |
| CO (g/bhph) | 0.28 | 0.28 | 0.28 | 0.25 | 0.24 | 0.24 | 0.24 | 0.25 |
| NOx (g/bhph) | 1.18 | 1.16 | 1.16 | 1.12 | 1.06 | 1.10 | 1.10 | 1.06 |
| PM (g/bhph) | * * * | * * * | 0.047 | * * * | 0.032 | * * * | * * * | * * * |
| Fuel used (g/bhph) | 125.67 | 127.24 | 127.24 | 127.56 | 125.29 | 129.43 | 127.33 | 127.40 |
| Mode 4 | | | | | | | | |
| HC (g/bhph) | 0.19 | 0.18 | 0.18 | 0.19 | 0.19 | 0.18 | 0.17 | 0.17 |
| CO (g/bhph) | 0.54 | 0.52 | 0.52 | 0.50 | 0.49 | 0.50 | 0.48 | 0.48 |
| NOx (g/bhph) | 1.76 | 1.75 | 1.75 | 1.73 | 1.69 | 1.70 | 1.66 | 1.68 |
| PM (g/bhph) | * * * | * * * | 0.036 | * * * | 0.028 | * * * | * * * | * * * |
| Fuel used (g/bhph) | 142.91 | 142.08 | 142.08 | 144.07 | 143.18 | 146.02 | 142.94 | 143.80 |

In this disclosure there are a number of individual features which are novel and inventive as illustrated by the examples. The disclosure includes each and every permutation of such features as part of the monopoly to be claimed.

What is claimed is:

1. A fuel additive composition comprising:

about 3-35% by weight of a nitrogen-containing compound selected from the group consisting of urea, cyanuric acid, triazine, and ammonia;

about 30-97% by weight of a carrier blend comprising:

about 30-75% by weight of an alkoxylated alcohol composition having the following general structure:

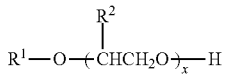

wherein $R^1$ is $C_6$-$C_{16}$, $R^2$ is H or $CH_3$, and

X is 1-7;

about 10-60% by weight of a polyalkylene glycol ester composition having the following general structure:

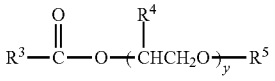

wherein $R^3$ is $C_{11}$-$C_{19}$, $R^4$ is H or $CH_3$, y is 1-20

$R^5$ is H or $COR^3$; and about 10-60% by weight of an alkanolamide composition having the following general structure:

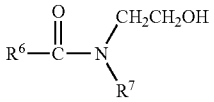

wherein $R^6$ is $C_{12}$-$C_{18}$;

$R^7$ is H or $CH_2CH_2OH$; and about 0.0025-25% by weight of water wherein the fuel additive composition is substantially homogeneous.

2. The composition of claim 1 wherein the nitrogen-containing compound is a urea.

3. The composition of claim 2 wherein the urea comprises about 10-32% by weight of the composition.

4. The composition of claim 3 wherein the urea comprises about 12-28% by weight of the composition.

5. The composition of claim 2 wherein the alkoxylated alcohol comprises about 33-55% by weight of the composition.

6. The composition of claim 2 wherein $R^1$ is $C_9$-$C_{11}$ and x is 2.5.

7. The composition of claim 2 wherein the polyalkylene glycol ester comprises about 25-40% by weight of the composition.

8. The composition of claim 7 wherein the polyalkylene glycol ester comprises about 25-33% by weight of the composition.

9. The composition of claim 2 wherein $R^3$ is $C_{17}$ and $R^5$ is $COR^3$.

10. The composition of claim 2 wherein the alkanolamide comprises about 25-40% by weight of the composition.

11. The composition of claim 10 wherein the alkanolamide comprises about 25-33% by weight of the composition.

12. The composition of claim 2 wherein $R^6$ is $C_{17}$ and $R^7$ is $CH_2CH_2OH$.

13. A fuel additive concentrate composition comprising:

about 80-20% by weight of an additive constituent comprising:

about 3-35% by weight of a nitrogen-containing compound selected from the group consisting of urea, cyanuric acid, triazine, and ammonia;

about 30-97% by weight of a carrier blend comprising:

about 30-75% by weight of an alkoxylated alcohol composition having the following general structure:

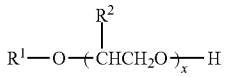

wherein $R^1$ is $C_6$-$C_{16}$, $R^2$ is H or $CH_3$,

And x is 1-7;

about 10-60% by weight of a polyalkylene glycol ester composition having the following general structure:

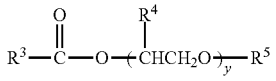

wherein $R^3$ is $C_{11}$-$C_{19}$, $R^4$ is H or $CH_3$,

Y is 1-20, $R^5$ is H or $COR^3$; and about 10-60% by weight of an alkanolamide composition having the following general structure:

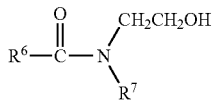

wherein $R^6$ is $C_{12}$-$C_{18}$, $R^7$ is H or $CH_2CH_2OH$; and about 0.0025-25% by weight of water; and about 20-80% by weight of a solvent, wherein the fuel additive composition is substantially homogeneous.

14. The composition of claim 13 wherein the solvent is a fuel selected from the group consisting of diesel, gasoline, kerosene, and mixtures thereof.

15. The composition of claim 13 wherein the additive constituent comprises about 70-30% by weight of the concentrate and the fuel comprises about 30-70% by weight of the concentrate.

16. The composition of claim 15 wherein the additive constituent comprises about 60-40% by weight of the concentrate and the fuel comprises about 40-60% by weight of the concentrate.

17. The composition of claim 13 wherein the nitrogen-containing compound is urea.

18. The composition of claim 17 wherein the urea comprises about 10-32% by weight of the additive constituent.

19. The composition of claim 18 wherein the urea comprises about 12-28% by weight of the additive constituent.

20. The composition of claim 13 wherein the alkoxylated alcohol comprises about 33-55% by weight of the additive constituent.

21. The composition of claim 13 wherein $R^1$ is $C_9$-$C_{11}$ and x is 2.5.

22. The composition of claim 13 wherein the polyalkylene glycol ester comprises about 25-45% by weight of the additive constituent.

23. The composition of claim 22 wherein the polyalkylene glycol ester comprises about 25-55% by weight of the additive constituent.

24. The composition of claim 13 wherein $R^3$ is $C_{17}$ and $R^5$ is $COR^3$.

25. The composition of claim 13 wherein the alkanolamide comprises about 25-40% by weight of the additive constituent.

26. The composition of claim 25 wherein the alkanolamide comprises about 25-33% by weight of the additive constituent.

27. The composition of claim 13 wherein $R^6$ is $C_{17}$ and $R^7$ is $CH_2CH_2OH$.

28. A fuel composition formulated to produce reduced NOx emissions when subject to combustion in an internal combustion engine comprising:

about 97-99% by weight of a hydrocarbon-containing fuel; and about 0.01-3% by weight of a fuel additive concentrate comprising:

about 80-20% by weight of an additive constituent comprising:

about 3-35% by weight of a nitrogen-containing compound selected from the group consisting of urea, cyanuric acid, triazine, and ammonia;

about 30-97% by weight of a carrier blend comprising:

about 30-75% by weight of an alkoxylated alcohol composition having the following general structure:

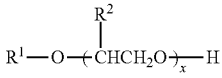

wherein $R^1$ is $C_6$-$C_{16}$, $R^2$ is H or $CH_3$, and

X is 1-7;

about 10-60% by weight of a polyalkylene glycol ester composition having the following general structure:

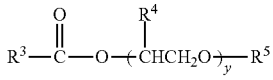

wherein $R^3$ is $C_{11}$-$C_{19}$, $R^4$ is H or $CH_3$, y is 1-20

$R^5$ is H or $COR^3$; and about 10-60% by weight of an alkanolamide composition having the following general structure:

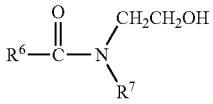

wherein $R^6$ is $C_{12}$-$C_{18}$;

$R^7$ is H or $CH_2CH_2OH$; and about 0.0025-25% by weight of water wherein the fuel additive composition is substantially homogeneous.

29. The composition of claim 28 wherein the fuel is selected from the group consisting of diesel, gasoline and kerosene.

30. The composition of claim 28 wherein the nitrogen-containing compound is urea.

31. The composition of claim 30 wherein the urea comprises about 10-32% by weight of the additive.

32. The composition of claim 31 wherein the urea comprises about 12-28% by weight of the additive.

33. The composition of claim 28 wherein the alkoxylated alcohol comprises about 33-55% by weight of the additive.

34. The composition of claim 33 wherein $R^1$ is $C_9$-$C_{11}$ and x is 2.5.

35. The composition of claim 28 wherein the polyalkylene glycol ester comprises about 25-40% by weight of the additive.

36. The composition of claim 35 wherein the polyalkylene glycol ester comprises about 25-33% by weight of the additive.

37. The composition of claim 28 wherein $R^3$ is $C_{17}$ and $R^5$ is $COR^3$.

38. The composition of claim 28 wherein the alkanolamide comprises about 25-40% by weight of the additive constituent.

39. The composition of claim 38 wherein the alkanolamide comprises about 25-33% by weight of the additive constituent.

40. The composition of claim 28 wherein $R_6$ is $C_{17}$ and $R_7$ is $CH_2CH_2OH$.

* * * * *